US005983405A

United States Patent [19]

Casale

[11] Patent Number: 5,983,405

[45] Date of Patent: Nov. 16, 1999

[54] DEVICE FOR ADJUSTING AND SECURING A HELMET TO THE HEAD OF A USER

[75] Inventor: Maurizio Casale, Villastellone, Italy

[73] Assignee: Camau System Di Casale & C.S.N.C., Torino, Italy

[21] Appl. No.: 09/025,688

[22] Filed: Feb. 18, 1998

[51] Int. Cl.[6] ..... A42B 3/08

[52] U.S. Cl. ..... 2/421; 2/417

[58] Field of Search ..... 2/410, 411, 421, 2/425, 417, 418, 420, 422

[56] References Cited

U.S. PATENT DOCUMENTS

| | | | |
|---|---|---|---|
| 5,551,094 | 9/1996 | Navone | 2/421 |
| 5,581,819 | 12/1996 | Garneau | 2/421 |
| 5,638,551 | 6/1997 | Lallemand | 2/421 |
| 5,659,900 | 8/1997 | Arney et al. | 2/417 |
| 5,704,072 | 1/1988 | Garneau | 2/421 |
| 5,774,901 | 7/1998 | Minami | 2/421 |
| 5,794,272 | 8/1998 | Workman et al. | 2/421 |

*Primary Examiner*—Michael A. Neas
*Attorney, Agent, or Firm*—Helfgott & Karas, P C.

[57] ABSTRACT

A device for adjusting and securing a helmet to the head of a user. The helmet comprises a shell, a pair of temporal straps, a pair of rear straps and a chin-strap provided with a closure, connected together through anchoring and shifting members. The device also includes a stretcher fastened to said shell for stretching an elastic spring provided in said rear straps and adjusting to the desired tension said chin-strap, and a releasing button to release said elastic spring. The stretcher includes a capstan-like rotatable lever adapted to pull and apply a tension to said elastic means when it is manually rotated.

9 Claims, 2 Drawing Sheets

DEVICE FOR ADJUSTING AND SECURING A HELMET TO THE HEAD OF A USER

BACKGROUND OF THE INVENTION

1. Field of the Invention

The present invention refers to safety helmets and more particularly to a device for adjusting and securing a helmet to the head of a user, such as a cyclist, a worker and so on, as well as to a helmet incorporating such device.

2. Description of the Related Art

It is known that presently the helmets of the above type are not manufactured in a custom size for each user, but are manufactured in a few standard sizes, each provided with an inner cap having a padding of different thickness to realize the desired inner dimension of the helmet. It is also evident that an adjusting operation is required to adjust such caps to the proper size of the user's head.

It is also known that an adjustable length chin-strap is required in order to firmly fit the helmet over the user's head, in helmets for protecting workers this chin-strap being request by safety regulations.

Until now this chin-strap was adapted to be fastened (or buckled) when the helmet is worn and to be unfastened when it is removed, but often the user wishes only to slacken or loosen the chin-strap for a better comfort of the throat after a strain, e.g. after riding uphill.

With the prior art helmets, the user often unfastens the chin-strap in lieu of slackening it, which is an imprudent act since the helmet is no longer secured to the user's head and he/she could easily forget to fasten it again before driving off or resuming working.

It is an object of the present invention to provide a device allowing to adjust and secure a helmet to the user's head in a simple and quick manner, while allowing at the same time to slacken and tighten the helmet chin-strap without unfastening this latter.

SUMMARY OF THE INVENTION

The above object is achieved through a device for adjusting and securing a helmet to the head of a user, said helmet comprising a shell, a pair of temporal straps, a pair of rear straps, a chin-strap provided with a closure, said straps being connected together through anchoring and shifting members, a stretcher fastened to said shell for stretching elastic means provided in said rear straps and adjusting to the desired tension said chin-strap, and a releasing button to release said elastic means.

Additional advantageous features are recited in the depending claims.

BRIEF DESCRIPTION OF THE DRAWINGS

The invention will now be disclosed in details with reference to some preferred but not limiting embodiments thereof illustrated in the attached drawings, in which.

DETAILED DESCRIPTION OF THE PREFERRED EMBODIMENTS

Figure 1:
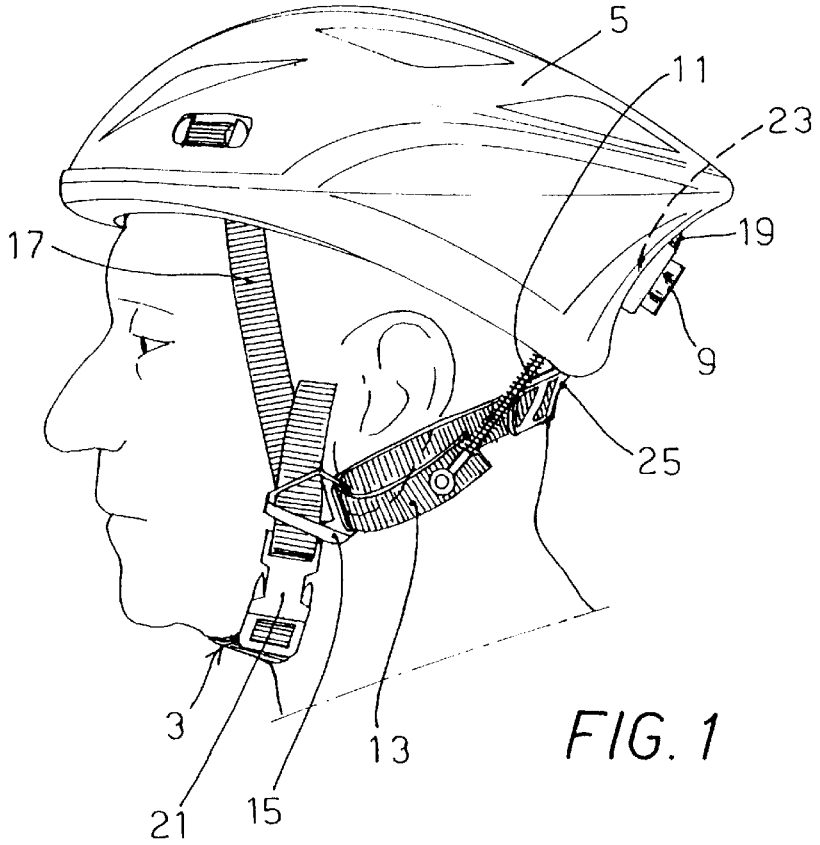
FIG. 1 is an elevation side view of a helmet equipped with a chin-strap and a stretching device secured to the helmet shell illustrating a first embodiment of the invention.

As clearly shown in the Figures, a device 1 according to the invention comprises two temporal straps 17, extending from the temple to the chin of the user, each having one end fixed to the shell 5 of the helmet and the other end connected to an anchoring and shifting member 15, a chin-strap 3 provided with a closure or buckle 21 of known type, and two rear straps 13 each having one end connected to a member 15 and the other to the shell 5, near the user nape.

Each member 15 has a substantially triangular shape and is provided with a first slot for the passage of the strap 17, extending from the temple to the chin, and a second slot for the passage of the rear strap 13 extending from the member 15 to the nape portion of the shell.

Figure 3:
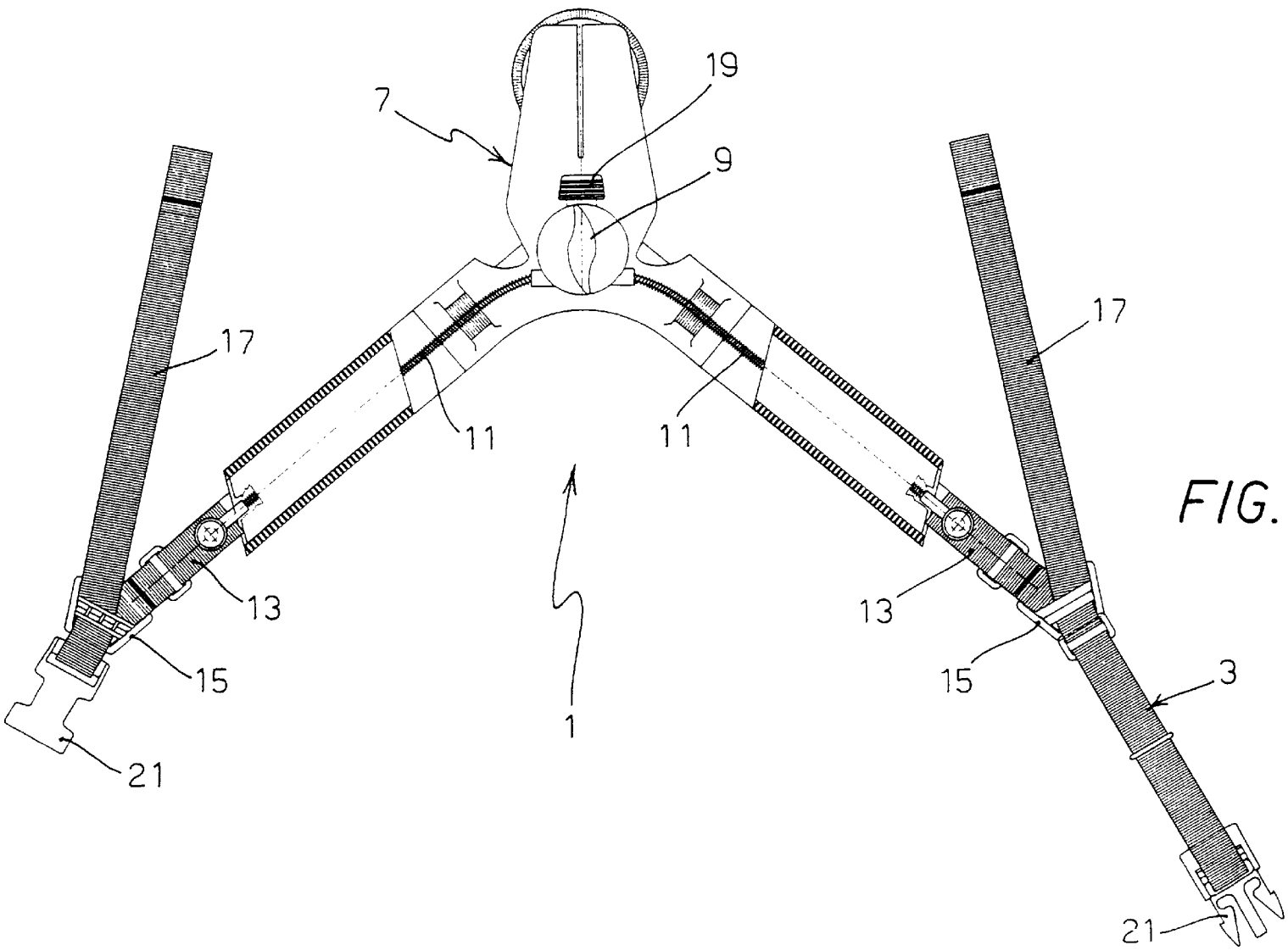
FIG. 3 is a detailed view of a strap assembly for adjusting and securing a helmet to the head of a user in accordance with the invention.

With particular reference to FIG. 3, each rear strap 13 comprises an elastic portion 11, acting as a tensioning means and formed for example by a length of a helical or spiral spring, that is connected to a stretcher 7 adapted to both securing the helmet to the user's head and adjusting the chin-strap to the desired tension.

The stretcher or stretching device 7 comprises a rotatable lever 9, such as that of a capstan, adapted to pull the elastic portions 11 and apply a tension to such elastic means 11 when it is manually rotated.

A release button 19 is provided near the tensioning lever 9 to release the elastic means 11 that have been stretched, i.e. tensioned, by the lever 9.

In use the helmet 3 is fitted to the head of the user by passing the strap 3 under the chin and joining together the members of the buckle 21 but leaving the strap relatively loose. At this time, in order to tension the chin-strap 3 and secure the helmet 5 to the user's head, the user acts on the stretcher 7 by rotating the lever 9 that in turn stretches the elastic means 11.

To remove the helmet 5 from the head the user presses the release 19 button disengaging the elastic means 11 that will return to their original unstretched length.

In accordance with a first embodiment of the invention, illustrated in FIG. 1, both the lever 9 for actuating the stretcher 7 and the release button 19 are housed in a dedicated seat 23—formed or applied on the shell outer surface of the helmet—and secured thereto.

Figure 2:
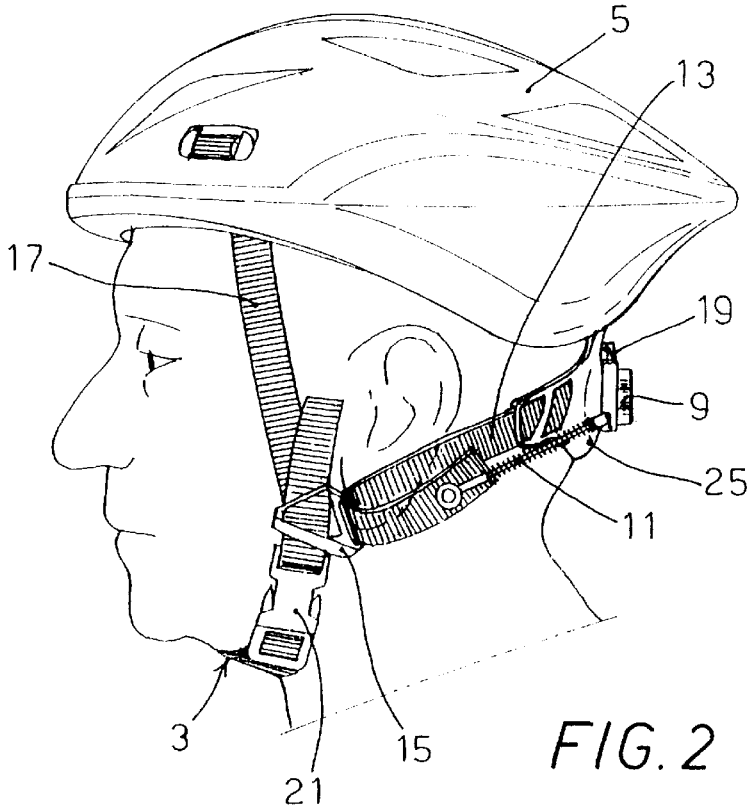
FIG. 2 is an elevation side view of a helmet equipped with a chin-strap and a stretching device secured to the nape cap of the chin-strap, which cap is in turn secured to the helmet shell, in accordance with a second embodiment of the invention.

In accordance with another embodiment of the invention, illustrated in FIG. 2, the lever 9 for actuating the stretcher 7 is secured to the cap 25 of the chin-strap 3, and the cap is fastened to the helmet by conventional known means. After the cap 25 has been fastened to the helmet 5, the working of this embodiment is the same as described above.

The embodiments of the invention have been disclosed and illustrated with particular reference to a safety helmet for cyclists, but it is evident that the present invention can be applied also in safety helmets for workers, in military helmets, as well as in other types of sport helmets and so on.

In the disclosed embodiment the stretcher is formed as a capstan, but other suitable forms of stretching means can be used for this purpose.

I claim:

1. A device for adjusting and securing a helmet to the head of a user, said device comprising a shell, a pair of temporal straps, a pair of rear straps, a chin-strap provided with a closure, said straps being connected together through anchoring and shifting members, a stretcher fastened to said shell for stretching elastic means provided in said rear straps and adjusting to the desired tension said chin-strap, and a releasing button to release said elastic means.

2. A device as claimed in claim 1, wherein said elastic means comprises a spring in said rear straps.

3. A device as claimed in claim 2, wherein said stretcher comprises a rotatable lever of a capstan to which said elastic means are connected, said lever being adapted to pull and apply a tension to said elastic means when it is manually rotated.

4. A device as claimed in claim 1, wherein each of said members has a substantially triangular shape and is provided with a first slot for the passage of one of said temporal straps extending from the temple to the chin, and a second slot for the passage of one of said rear straps extending from said member to a nape portion of the shell.

5. A device as claimed in claim 3, wherein said lever and release button are housed in a seat on an outer surface of said shell and secured thereto.

6. A device as claimed in claim 3, wherein said lever is secured to a cap of said chin-strap that is fastened to the shell.

7. A safety helmet incorporating an adjusting and securing device as claimed in claim 1.

8. A device according to claim 2, wherein said spring is a length of helical spring.

9. A device according to claim 2, wherein said spring is a length of spiral spring.

* * * * *